US007397442B2

(12) United States Patent
Hawes

(10) Patent No.: US 7,397,442 B2
(45) Date of Patent: Jul. 8, 2008

(54) RADOME WITH HEATING ELEMENT

(75) Inventor: Jeffrey O. Hawes, Portsmouth, RI (US)

(73) Assignee: KVH Industries, Inc., Middletown, RI (US)

( * ) Notice: Subject to any disclaimer, the term of this patent is extended or adjusted under 35 U.S.C. 154(b) by 0 days.

(21) Appl. No.: 11/288,040

(22) Filed: Nov. 28, 2005

(65) Prior Publication Data

US 2007/0120759 A1 May 31, 2007

(51) Int. Cl.
*H01Q 1/42* (2006.01)
*H01Q 1/02* (2006.01)

(52) U.S. Cl. ..... 343/872; 343/704

(58) Field of Classification Search ..... 343/872, 343/704

See application file for complete search history.

(56) References Cited

U.S. PATENT DOCUMENTS 4,620,890 A 11/1986 Myers et al. ..... 156/196
5,353,037 A 10/1994 Jones
5,528,249 A 6/1996 Gafford et al. ..... 343/704
6,462,717 B1 * 10/2002 Wheelock et al. ..... 343/872

FOREIGN PATENT DOCUMENTS

JP 61129903 A * 6/1986

OTHER PUBLICATIONS

International Search Report for PCT/US06/44672.

* cited by examiner

*Primary Examiner*—Hoang V. Nguyen
*Assistant Examiner*—Robert Karacsony
(74) *Attorney, Agent, or Firm*—Foley Hoag LLP

(57) ABSTRACT

An antenna assembly includes an antenna and a radome that covers the antenna. The radome can be single- or double-walled, and, to prevent accumulation of dew on the radome, a radome heater operates to heat the radome's surface temperature in a relatively uniform manner by raising the radome air space's air temperature. To increase the radome heater's energy efficiency, an insulating layer thermally insulates the radome heater from the surface on which it is mounted.

5 Claims, 5 Drawing Sheets

RADOME WITH HEATING ELEMENT

BACKGROUND OF THE INVENTION

1. Field of the Invention

The present invention is directed to radome heating.

2. Background Information

Antennas are often provided with radomes to protect them from the elements. Radome shapes and materials are typically so selected as to keep adverse effects from the radome's reflecting, refracting, and absorbing microwaves to a minimum. But these adverse effects increase when ice, snow, frost, or dew coat the radome. So some designers provide heating elements to melt ice and snow and evaporate dew. Sometimes these heating elements include resistive wires that are embedded in or otherwise affixed to the radome. In other cases they heat air, which in turn heats the radome walls. When the antenna system is installed in a mobile platform such as a camper or other automobile, battery-life considerations make it important to limit the power that radome heating requires.

SUMMARY OF THE INVENTION

We have found a simple expedient for reducing such a system's power requirements significantly. Specifically, in systems that operate by heat conducting from heated air to the radome's walls, we thermally insulate the heater from the platform that supports it. It turns out that such systems' power requirements tend to be less than those of comparable systems that provide no such insulation.

BRIEF DESCRIPTION OF THE DRAWINGS

The invention description below refers to the accompanying drawings, of which.

DETAILED DESCRIPTION OF AN ILLUSTRATIVE EMBODIMENT

Figure 1:
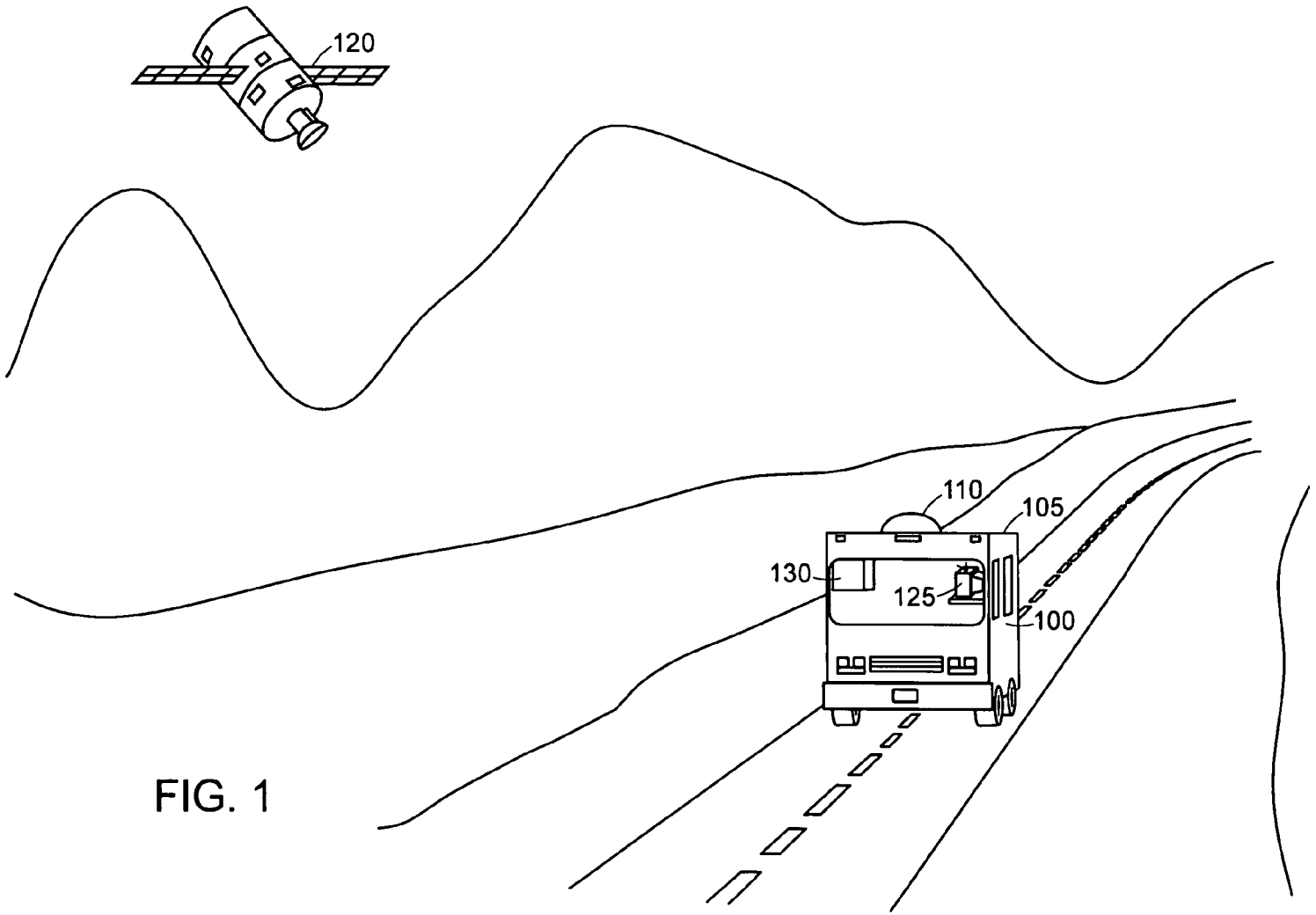
FIG. 1 is a diagram of an antenna unit mounted on top of a vehicle to receive signals from a satellite.

FIG. 1 depicts a vehicle 100 that includes a roof rack 105 on which is mounted an antenna unit 110 for receiving from a satellite 120 signals that it down-converts and sends for detection and decoding to a receiver 130, such as an IRD (integrated receiver and decoder). The receiver 130 then sends the signals thus decoded to the vehicle's audio/video entertainment system 125. Although the antenna unit's platform in the drawing is a vehicle 100, the present invention's technique can be employed with other types of platforms, stationary or non-stationary.

Figure 2:
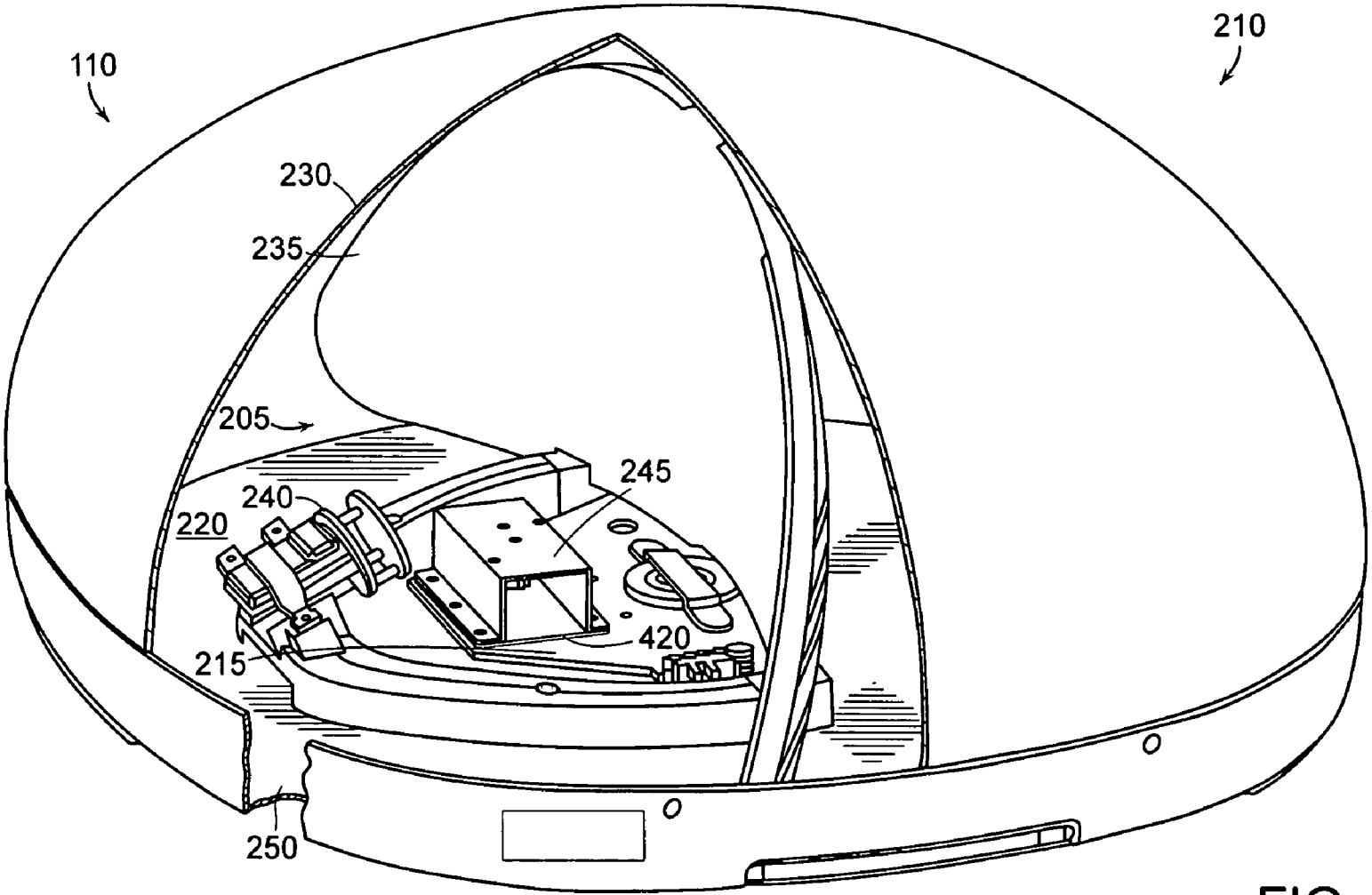
FIG. 2 is a partially broken-away view of the antenna unit.

FIG. 2 shows that the antenna unit 110 includes an antenna assembly 205 and a radome 210 that encloses the antenna assembly 205. The antenna assembly 205 is pivotably mounted on a mounting plate 215 that in turn is rotatably mounted on a base plate 220 to which the radome 230 is secured. In this embodiment, the radome wall 230 and the base plate 220 together define a radome air space in which the antenna assembly 205 is disposed.

The illustrated antenna assembly 205 includes an antenna reflector 235, which focuses microwaves received from within a narrow antenna beam onto a low-noise block (LNB) converter 240. The LNB converter 240 amplifies and down-converts the received microwaves to a lower frequency band for transmission to the receiver. A motor (not shown) that rotates the horizontal mounting plate 215 on which the reflector 235 and LNB converter 240 are mounted provides beam-azimuth control. Another motor tilts the reflector 235 and LNB converter with respect to the plate 215 so as to control beam elevation.

The antenna unit 110 includes a radome heater 245 that operates to raise the air temperature within the radome air space. The radome heater 245 is preferably mounted on the rotating plate 215 in front of the antenna reflector 235 so that the reflector shields only a small portion of the radome from the heater's output. But the radome heater can instead be mounted elsewhere on the rotating plate or on some other, non-rotating surface within the enclosure. It can also be mounted outside of the radome enclosure, in which case a conduit would direct warm air from the radome heater into the radome air space.

Figure 3:
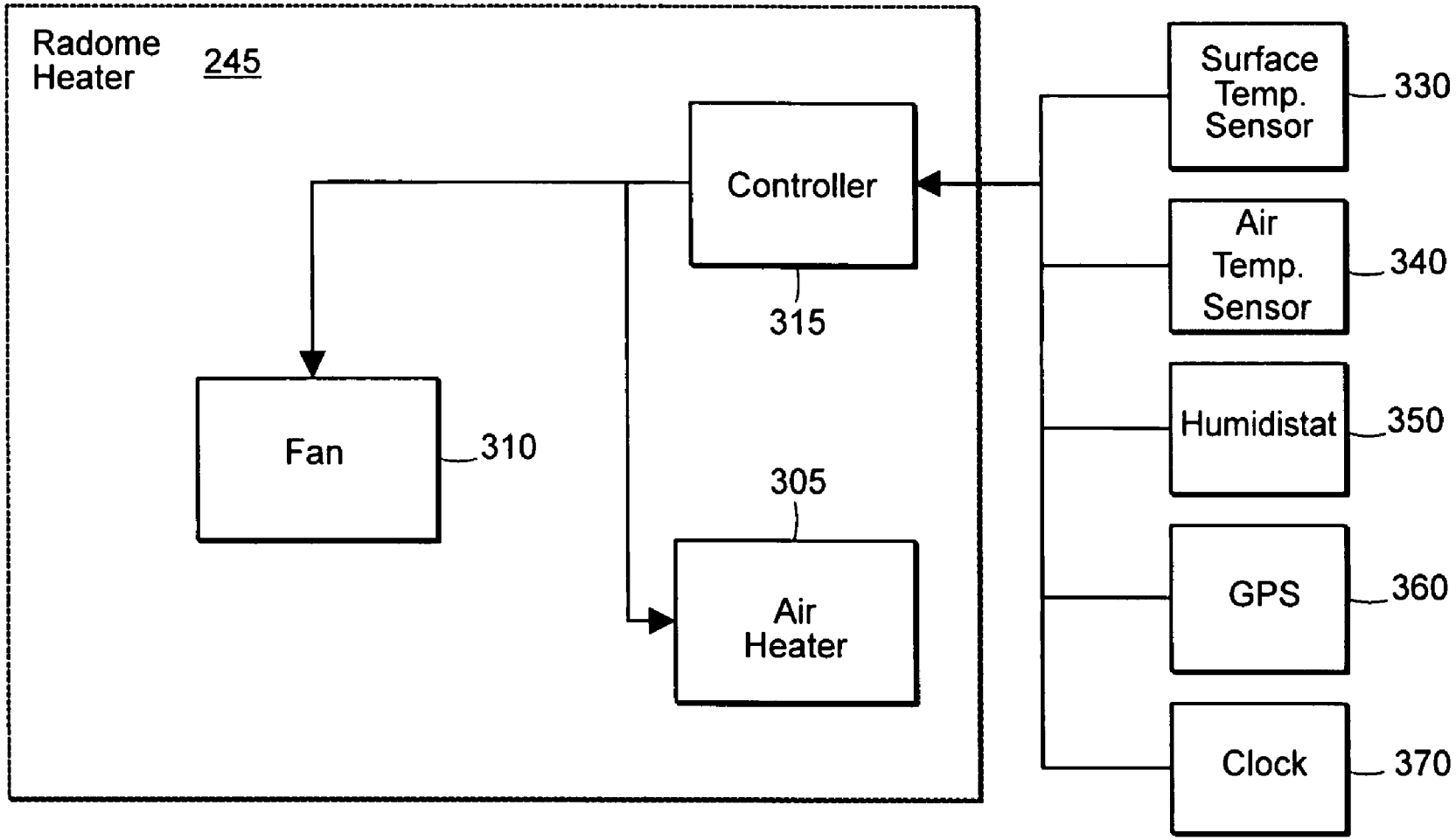
FIG. 3 is a block diagram of a heater system for the radome.

FIG. 3 is a block diagram of one possible type of radome heater 245. The radome heater 245 includes an air heater 305 and a fan 310, both of which a controller unit 315 operates. The controller unit 315 receives signals from various input devices (detailed below), determines from these signals whether the radome heater 245 should be on or off, and operates it accordingly.

For the sake of illustration, FIG. 3 depicts the radome heater as receiving inputs from a surface-temperature sensor 330, an air-temperature sensor 340, a humidistat 350, a GPS receiver 360, and a clock 370, although most embodiments will not use so many input devices. In a single-wall radome, the sensors can be placed on the inner or outer surface of the radome wall or on any other surface inside or outside the radome. The sensors can be used to measure the temperature within the radome air space, the temperature of the radome's external surface, the external humidity, and/or other variables that may bear on deciding whether to change the radome air space's air temperature.

Each sensor measures a respective variable and sends the controller a signal that represents the variable's value. The controller 315 receives these sensor signals and possibly signals from other input devices. In response to these signals, the controller operates the radome heater according to predetermined criteria. In some embodiments, the fan 310 and air heater 305 may be controlled separately, and the control strategy may include varying the fan and/or air heater's drive level throughout a continuous range. For the sake of example, though, we will assume that the controller 315 merely turns the air heater and fan on and off together. It may so respond to temperature and humidity sensors, for example, as to turn the heater on when the radome's exterior-surface temperature falls to some temperature just above the exterior dew point and turn it off when that temperature reaches some higher value.

Embodiments of the invention may use many other control strategies, of course. Some, for example, may depend on the time of day; this is why FIG. 3 includes clock 370. And it includes a GPS receiver 360 because satellite-TV systems often have such receivers for other reasons, and, since such a receiver provides a time-indicating output, it can be used in place of a separate clock. One type of time-dependent-control strategy would be to respond only to interior air temperature and only during certain times of the day. For example, the system may keep the heater turned off during the day, turning it on at night only if the interior falls below some threshold temperature. And, although dewpoint information would be helpful, that threshold may for the sake of simplicity be independent of the dew point. Some air temperature between the values of 0° C. and 30° C. would typically be adequate for this purpose.

Of course, the radome surface's temperature profile will depend on the particular radome configuration and the airflow patterns within the radome air space. But use of heated air rather than, e.g., heating wires enables a designer readily to achieve a desired level of temperature uniformity and thereby limit the power expenditure required to prevent dew or remove it.

Figure 4:
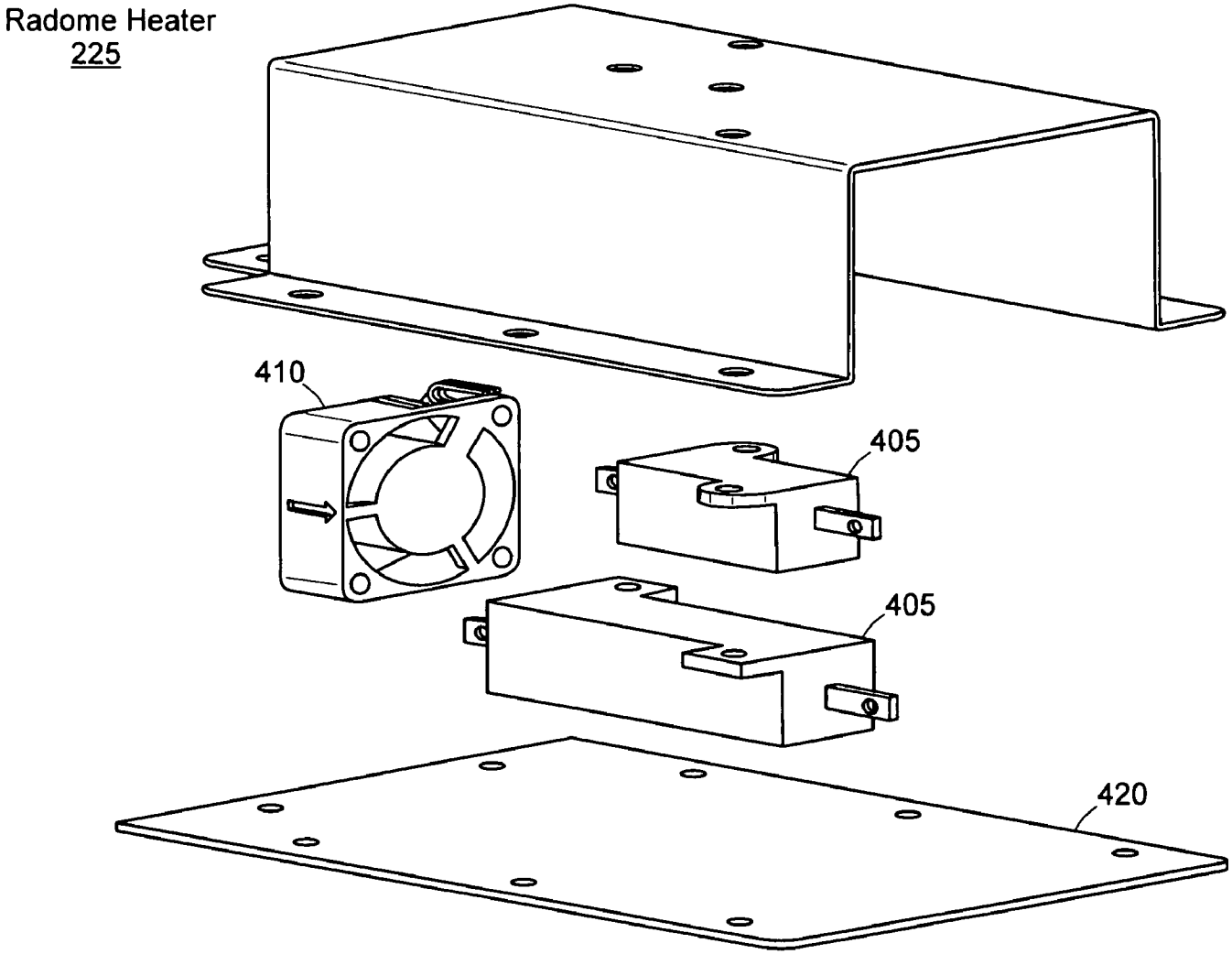
FIG. 4 is an exploded view of a radome heater.
Figure 5:
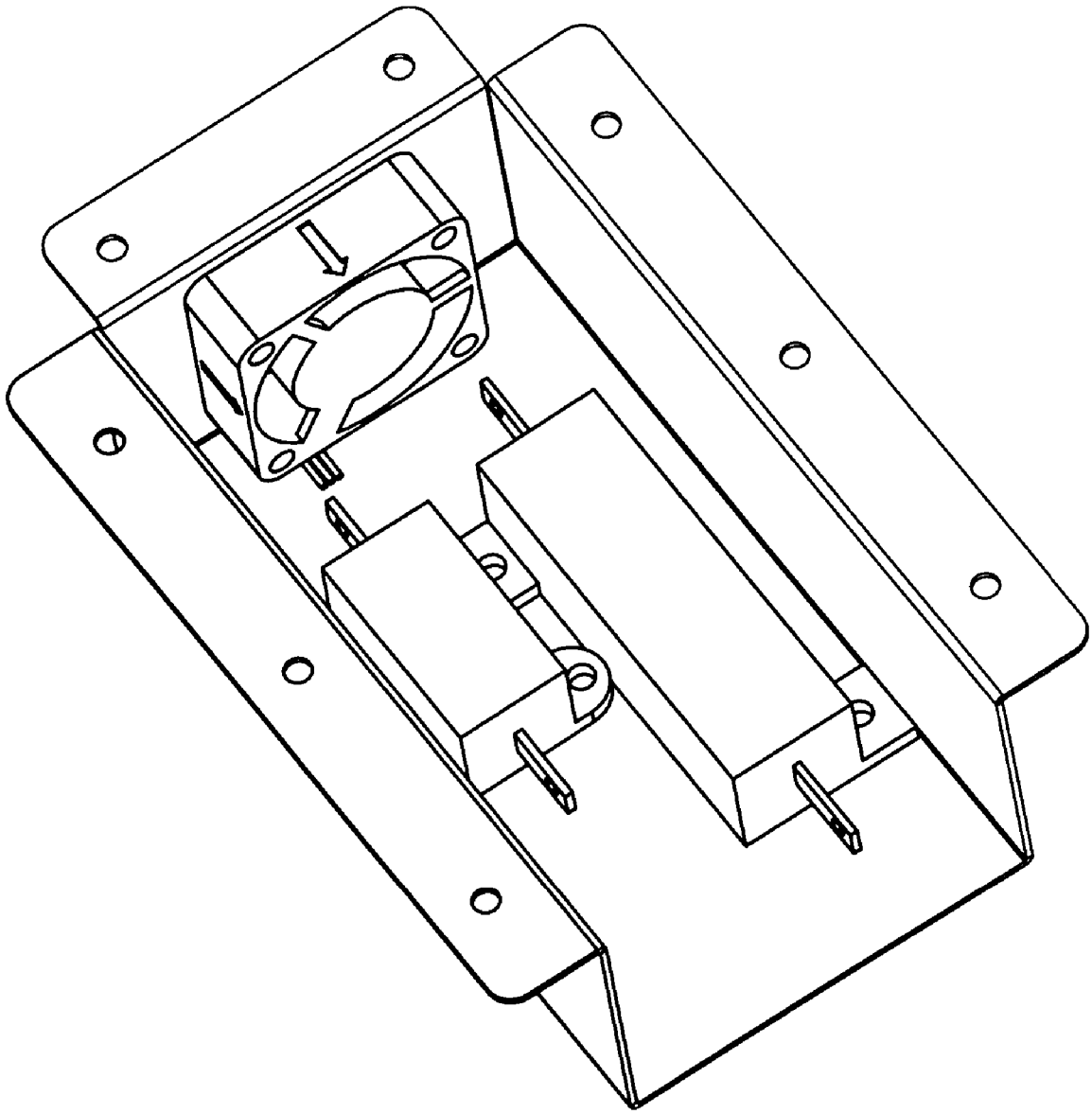
FIG. 5 is a bottom view of the radome heater with its base plate removed.

According to the invention, energy consumption can be further reduced by employing an expedient that FIG. 4 illustrates. As FIGS. 4 and 5 illustrate, the radome heater includes two power resistors 405 and a fan 410, which wires not shown in the drawing connect to the controller. Current flowing through the power resistors, which act as the heater, causes heat dissipation, and the fan causes air flow past the resistors to enable resistor heat to be conducted to the air efficiently. The resultant air circulation additionally facilitates conduction from the air to the radome wall.

As FIG. 4 in particular shows, an insulating layer 420 is disposed between power resistors 405 and the surface on which they are mounted. Specifically, the insulating layer 420 is disposed on the mounting plate 215 that FIG. 2 shows. The insulating layer's average thermal conductivity should be less than 0.6 BTU/ft-hr-° F. (1.04 watt/m.-K), and preferably less than 0.1 BTU/ft-hr-° F. (0.17 watt/m.-K). Examples of materials that meet these criteria are closed-cell neoprene foam and wood. These criteria can also be satisfied by providing spacers made of materials whose conductivities are greater but that leave large enough air spaces so that the average conductivity falls within at least one of the ranges mentioned above. It turns out that simply providing such insulation significantly reduces the required energy expenditure. I have obtained advantageous results, for example, by using as the insulating layer a solid 0.060-in.-(0.15-cm.-) thick gasket made of a material whose thermal conductivity is 0.045 BTU/ft-hr-° F. (0.078 watt/m.-K).

Other embodiments may be arranged differently from the one that the drawings illustrate. For example, some additional power savings may result from making the radome double-walled and heating only the air space between the two radome walls. Space considerations would typically dictate placing the heater outside the air space but providing some conduit to conduct heat from the heater to the air space through the inner or outer radome wall.

Also, although the invention has been described by reference to an embodiment in which the radome houses a reflector-type antenna and is therefore approximately hemispherical, the present invention's teachings can also be quite beneficial for radomes used with, e.g., antenna arrays. Indeed, since such radomes tend to be relatively flat, they are particularly vulnerable to dew accumulation.

By employing the present invention's teachings, a radome can be kept free of dew with only a modest power expenditure. It therefore constitutes a significant advance in the art.

What is claimed is:

1. An antenna assembly comprising:

A) an antenna oriented to form an antenna beam in a forward direction therefrom;

B) a radome so mounted on the antenna assembly as to cover the antenna, the radome comprising one or more radome walls disposed in front of the antenna and defining a radome air space in the area enclosed by the outermost radome wall;

C) a radome heater mounted on a mounting surface and operable to heat the radome by raising the radome air space's air temperature; and D) a thermally insulating layer including a solid gasket positioned between the radome heater and the mounting surface.

2. An antenna assembly as defined in claim 1 wherein the majority of the heat applied to the radome by the radome heater flows thereto through air in the radome air space.

3. An antenna assembly as defined in claim 1 wherein the radome heater comprises an air heater for heating air and a fan for causing the air thus heated to flow in the radome air space.

4. An antenna assembly as defined in claim 1 wherein the insulating layer's thermal conductivity is less than 0.6 BTU/ft-hr-° F.

5. An antenna assembly as defined in claim 4 wherein the insulating layer's thermal conductivity is less than 0.1 BTU/ft-hr-° F.

* * * * *